US009314662B1

(12) United States Patent
Willison

(10) Patent No.: US 9,314,662 B1
(45) Date of Patent: Apr. 19, 2016

(54) CUSHIONED EXERCISE UNIT FOR HANDS AND WRISTS

(71) Applicant: George R. Willison, Cumming, GA (US)

(72) Inventor: George R. Willison, Cumming, GA (US)

( * ) Notice: Subject to any disclaimer, the term of this patent is extended or adjusted under 35 U.S.C. 154(b) by 4 days.

(21) Appl. No.: 14/568,449

(22) Filed: Dec. 12, 2014

(51) Int. Cl.
*A63B 71/00* (2006.01)
*A63B 26/00* (2006.01)
*A63B 21/00* (2006.01)

(52) U.S. Cl.
CPC ..... *A63B 21/1476* (2013.01); *A63B 21/00047* (2013.01)

(58) Field of Classification Search
CPC ..... A63B 21/00; A63B 21/00047; A63B 21/0005; A63B 21/00054; A63B 21/002; A63B 21/0023; A63B 21/068; A63B 21/4019; A63B 21/4035; A63B 21/4037; A63B 21/4027; A63B 23/00; A63B 23/12; A63B 23/14; A63B 23/16; A63B 23/1209; A63B 23/1227; A63B 23/1236
USPC ..... 482/92, 139, 148, 142, 141; 473/201–206, 549–551, 596, 597
See application file for complete search history.

(56) References Cited

U.S. PATENT DOCUMENTS 4,071,913 A 2/1978 Rector
5,466,206 A 11/1995 Fleming
5,607,380 A * 3/1997 Duty ..... A63B 21/00047 482/126
6,942,605 B1 * 9/2005 Sukhovitsky ..... A63B 21/0004 2/24
7,063,646 B1 * 6/2006 Slimi ..... A63B 22/14 482/141
7,156,791 B2 1/2007 Edwards
7,645,218 B2 * 1/2010 Potok ..... A63B 23/1245 482/139
8,460,160 B2 * 6/2013 Andrews ..... A63B 21/4001 482/44
2006/0089241 A1 * 4/2006 Klein ..... A63B 21/00047 482/141
2007/0117695 A1 * 5/2007 Endelman ..... A63B 21/00047 482/140
2009/0209373 A1 * 8/2009 Brodmann ..... A63B 59/40 473/526
2010/0248920 A1 * 9/2010 Morales ..... A63B 21/00047 482/141
2012/0214653 A1 * 8/2012 Tsou ..... A63B 21/00047 482/142
2013/0213408 A1 * 8/2013 Andrews ..... A63B 23/14 128/846
2013/0252791 A1 * 9/2013 Chang ..... A63B 21/00112 482/132
2013/0274078 A1 * 10/2013 Andrews ..... A63B 23/1227 482/141
2013/0324382 A1 12/2013 Wilson
2014/0135189 A1 * 5/2014 Thomason ..... A63B 23/1236 482/141

* cited by examiner

*Primary Examiner* — Oren Ginsberg
*Assistant Examiner* — Garrett Atkinson
(74) *Attorney, Agent, or Firm* — J.T. Hollin, Attorney at Law, P.C.

(57) ABSTRACT

Disclosed is a hand-grasped exercise unit to assist in reducing wrist and hand pain during exercises such as yoga. The device, normally used in pairs, is constructed for a user to rest the heel of the palm, fingers, and base of the thumb while engaging in exercises normally done in direct contact with a floor or other hard surface. The device comprises a frame having an upper platform, and a support base with two orthogonally-oriented side walls and a rear wall. An opening allows a user to insert four fingers of the hand between the two side walls and grasp a rounded lip on the upper surface of the unit. A main foam layer and a secondary foam layer are affixed to the top surface of the upper platform. The two foam layers are enclosed by a fabric cover to provide additional comfort.

20 Claims, 4 Drawing Sheets

CUSHIONED EXERCISE UNIT FOR HANDS AND WRISTS

CROSS-REFERENCES TO RELATED APPLICATIONS

Not applicable

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concept disclosed relates to exercise devices and equipment used for physical fitness training, particularly devices that require specific gripping postures by a user's hand or hands.

(2) Description of the Related Art, Including Information Disclosed Under 37 CFR 1.97 and 1.98

US #2013/0324382 (Dec. 5, 2013; Wilson). A non-planar exercise mat is disclosed comprising a plurality of detachable handheld implements, each handheld implement serving functions independently of the mat. Various embodiments include handles for assisting a user in performing a variety of exercises upon, or optionally using, the mat.

US #2014/0135189 (May 15, 2014; Thomason) An exercise device having a hemispherical handle, an internal support, and a foot support for performing a variety of pushup-type exercises. The hemispherical handle is designed to provide optimum support and comfort to the user. The internal support is attached to the handle in a way that permits the handle to move relative to the foot support, for example, by moving up and down, rotating, tilting from side to side, or revolving about a central axis. The foot support provides support for the handle. Pads may be removably attached to the foot support to provide the desired surface.

U.S. Pat. No. 7,063,646 (Jun. 20, 2006; Slimi) An apparatus (1) for making figures or body exercises in rotation, includes: a lower part (20) having non-skipping elements (22) on an exercise surface (S); a mobile upper part (10) rotating relatively to the lower pan (20), and elements (30) for coupling in rotation the respectively upper and lower parts (10, 20). The upper part (10) comprises a gripping piece (100) conformed to receive a part (M) of a user's (U) body.

U.S. Pat. No. 8,460,160 (Jun. 11, 2013; Andrews) A wrist saver device with an elastomeric body and an adjustable strap is provided for decreasing stress and strain of a user's wrist joint by elevating a heel of a user's hand and lessening the amount and degree of an extension of a user's wrist so as to comfort and cushion the user's wrist and substantially prevent the user's wrist from being positioned at a 90 degree fight angle and perpendicular to the user's forearm and hand when the user is performing yoga, pushups, hand stands, dips or other upper body weight bearing exercises.

US #2010/0248920 (Sep. 30, 2010; Morales) An article of manufacture designed to allow the performance of pushups comfortably, ergonomically, and in a balanced manner on a ground surface. The article in reference is composed of a pair of hand supports (left and right) made of plastic or similar material, and a plurality of cushions made of rubber, cloth, or similar materials. The supports have a base or bottom portion designed to contact the floor, and a top portion at an elevated position relative to the base and above the floor. The top portion of the supports provide space for the user's hands to rest in a position that is more ergonomic than if resting directly on the floor.

U.S. Pat. No. 7,156,791 (Jan. 2, 2007; Edwards) Disclosed are yoga grip blocks having one or more block sections and a grip section that provide support and comfort in the practice of yoga exercises. The invention includes preferred materials to fabricate yoga grip blocks and describes methods of using yoga grip blocks.

US #2013/0274078 (Oct. 17, 2013; Andrews) A wrist saver Yoga block includes a handle which decreases stress and strain of a user's wrist joint by lessening the degree of extension of a user's wrist so as to substantially prevent the user's wrist from being positioned at a 90 degree angle with respect to the user's hand when the user is performing Yoga poses, Pilates, push-ups, hand stands, dips or other upper body weight bearing exercises.

U.S. Pat. No. 5,466,206 (Nov. 14, 1995; Fleming) Exercise aids for doing inclined pushups which may be positioned on the top of an elevated surface e.g. a table top. The handle bar of each aid is held in one hand and the person plants the bottom of the feet on the floor and does the pushup. The aid has a handle bar which is inclined at an angle of about 30°±5° with respect to the bottom surface of the aid which supports it to permit back and forth push up type motion.

US #2012/0214653 (Aug. 23, 2012; Tsou) A yoga block in the preferred embodiment of the present invention is a prism-shaped triangular block that provides a stable and solid base on all sides, horizontally and vertically, and is equipped with ergonomically placed hand grooves and multiple level hand slots for tailored use. The device helps users refine their practice through safe and proper alignment various yoga postures. A yoga block in the preferred embodiment is preferably composed of lightweight yet sturdy materials such as: foam, cork, or natural wood, but is in no way limited to these suggested materials.

BRIEF SUMMARY OF THE INVENTION

The device disclosed is an exercise unit which serves as a cushioning device to aid in reducing wrist and hand pain and/or discomfort incurred during exercise done on a floor or other surface, such as yoga and pilates. The exercise unit comprises a main support frame which is approximately equal in size to the hand of an adult. The exercise unit may be roughly described as an essentially square-shaped box, having one open side. A user places the device upon a floor or other surface such that the open side is oriented orthogonally to the floor surface and facing away from the user. This arrangement causes one side of the box, designated as the "upper platform" to be oriented parallel to the surface and designated as the "top" side. The user then places his/her palm on the top side, thus simultaneously allowing insertion of four fingers of the hand into the open side. A layer of cushioning foam is permanently attached to the top side. Users of the exercise unit would normally use two of the devices, one for each hand, during exercise maneuvers.

DETAILED DESCRIPTION OF THE INVENTION

The objects, features, and advantages of the concept presented in this application are more readily understood when referring to the accompanying drawings. The drawings, totaling four figures, show the basic components and functions of embodiments and/or methods of use. In the several figures, like reference numbers are used in each figure to correspond to the same component as may be depicted in other figures.

Figure 1:
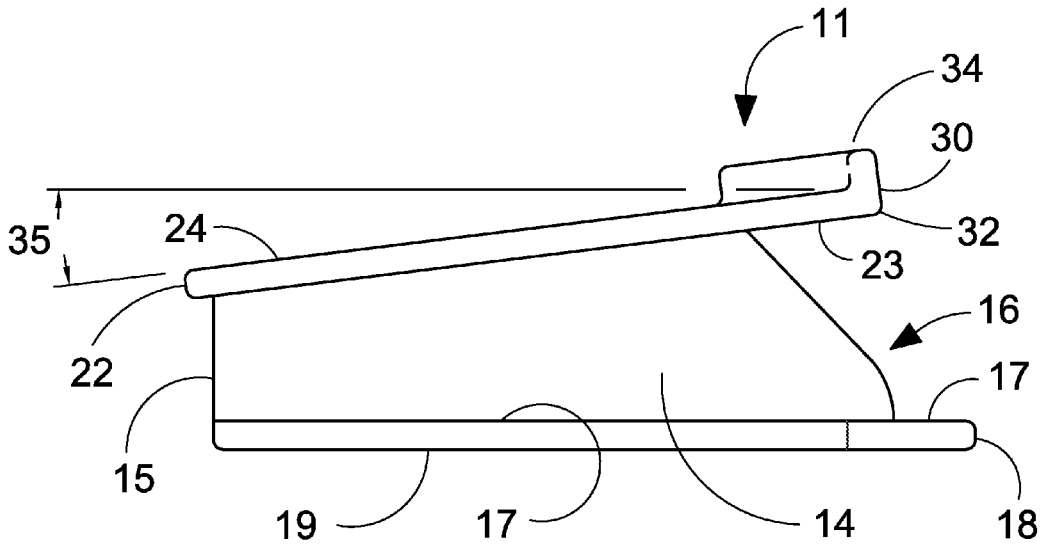
FIG. 1 presents an illustration of the basic frame 11 of the exercise unit, as viewed from the right side of the device, and further showing, in dashed lines, the interior contours of the frame 11.

The discussion of the present inventive concept will be initiated with FIG. 1, which illustrates the frame 11, isolated from the complete exercise unit 10, as viewed from the right side 14 of the frame 11. The frame 11 of the exercise unit 10, as illustrated in FIG. 1, is depicted in an intermediate stage of construction. The primary components of the frame 11, as visible in FIG. 1, are shown to be a support base 18 having an inner surface 17, an outer surface 19, a right wall 14, a rear wall 15, and an upper platform 22. The upper platform 22 further comprises an upper outer surface 24 which provides a surface for attachment of a main foam layer 27 and a secondary foam layer 28, to be attached atop the main foam layer 27. Both these foam layers 27, 28 are more readily visible in FIG. 2

Figure 2:
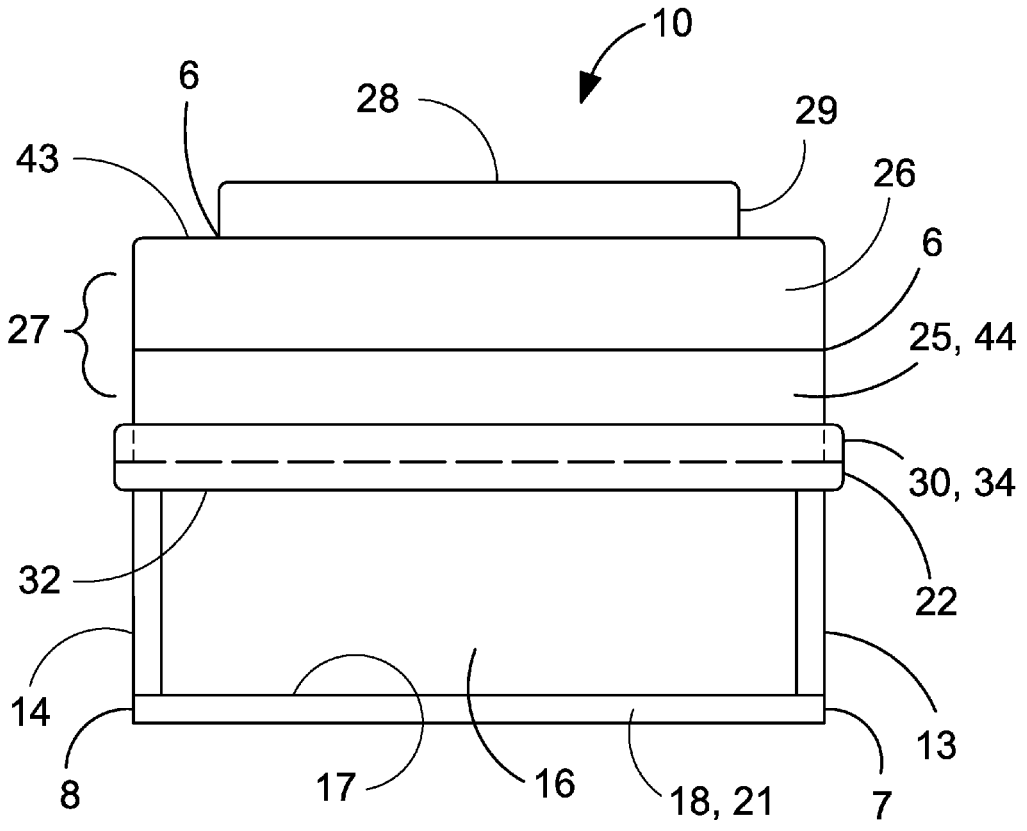
FIG. 2 is a direct frontal view of the exercise unit 10, looking directly into the opening 16, the opening being used for insertion of a user's fingers.

The upper platform 22 attaches to the rear wall 15, the right side wall 14, and the left side wall 13 (as shown in FIG. 2). An upraised lip 34, an upper rim 30, rim bottom perimeter 32 and the upper inner surface 23 are also depicted. An opening 16 is constructed of dimensions suitable for acceptance of four fingers of a user's a hand by means of using the finger joints to grasp generally the upper rim 30 and the rim bottom perimeter 32 when the maneuvers are performed in use of the entire exercise unit 10.

Also depicted in FIG. 1 is a slight sloping of the upper platform 22, from the upper rim 30 to the rear wall 15. This slope is defined as an "angle of slant" 35. The angle of slant 35 is determined as the angle between the slanted upper outer surface 24 of the upper platform 22 and the level horizon. In the preferred embodiment, the designed angle of slant 35 is six (6.0) degrees, however the angle of slant 35 is effective in a range between 4.0 and 14.0 degrees. This angle of slant 35 helps keep the user's hand in position on the exercise unit 10 and prevents the hand from inadvertently moving forward and sliding off the front of the device.

Reference is again made to FIG. 2, which is a frontal view of the complete exercise unit 10. Prominently situated above the upper platform 22 of the exercise unit 10 is a two-tiered main foam layer 27. The main foam layer 27, in the preferred embodiment, may be comprised of an upper foam segment 43 of a specific density, and a lower foam segment 44 of a different density from the upper foam segment 43.

The two differing foam segments 43, 44 are bound to each other by means of an adhesive 6. In this manner a dual-layered main foam layer 27, as shown in FIG. 2, is formed.

In FIG. 2, the frontal view of the exercise unit 10, looks directly into the opening 16, with the base 18 inner surface 17 visible. It is to be noted that the secondary foam layer 28 has a rounded front 29, which coincides with the rounded fronts 26, 25 of the upper foam segment 43 and the lower foam segment 44, respectively. The planar surface area of the secondary foam layer 28 is approximately one-half the size of that of the upper foam segment 43, and serves to keep the user's hand from sliding forward and off the exercise unit 10. The secondary foam layer 28 also helps the user keep his/her hand located exactly as desired on the exercise unit 10 and further, improves weight distribution. This occurs by causing a transfer of a portion of the user's body weight to the middle of the palm, where otherwise no weight loading would occur at all.

The upper foam segment 43 is characterized by a rounded front 26 and similarly, the lower foam segment 44 features a rounded front 25. The bottom surface of the lower foam segment 44 is attached to the outer surface 24 of the upper platform 22 by an adhesive 6. A smaller, secondary foam layer 28 is adhesively attached 6 to the upper surface of the upper foam segment 43. The secondary foam layer 28 also features a rounded front 29. The rounded fronts of the foam layers 27, 28 are shown more clearly in FIG. 3.

The main foam layer 27 is of a dense, soft composition, preferably latex, and is adhesively attached to the outer surface 24 of the upper platform 22. The opening 16 of the exercise unit 10 allows the user to place an open hand on top of the foam layers 27, 28 and wrap the fingers about the upper rim 30, lip 34, and rim bottom perimeter 32 and further, protrude the fingers inside the opening 16 for an efficient, very comfortable, and unique position.

Figure 3:
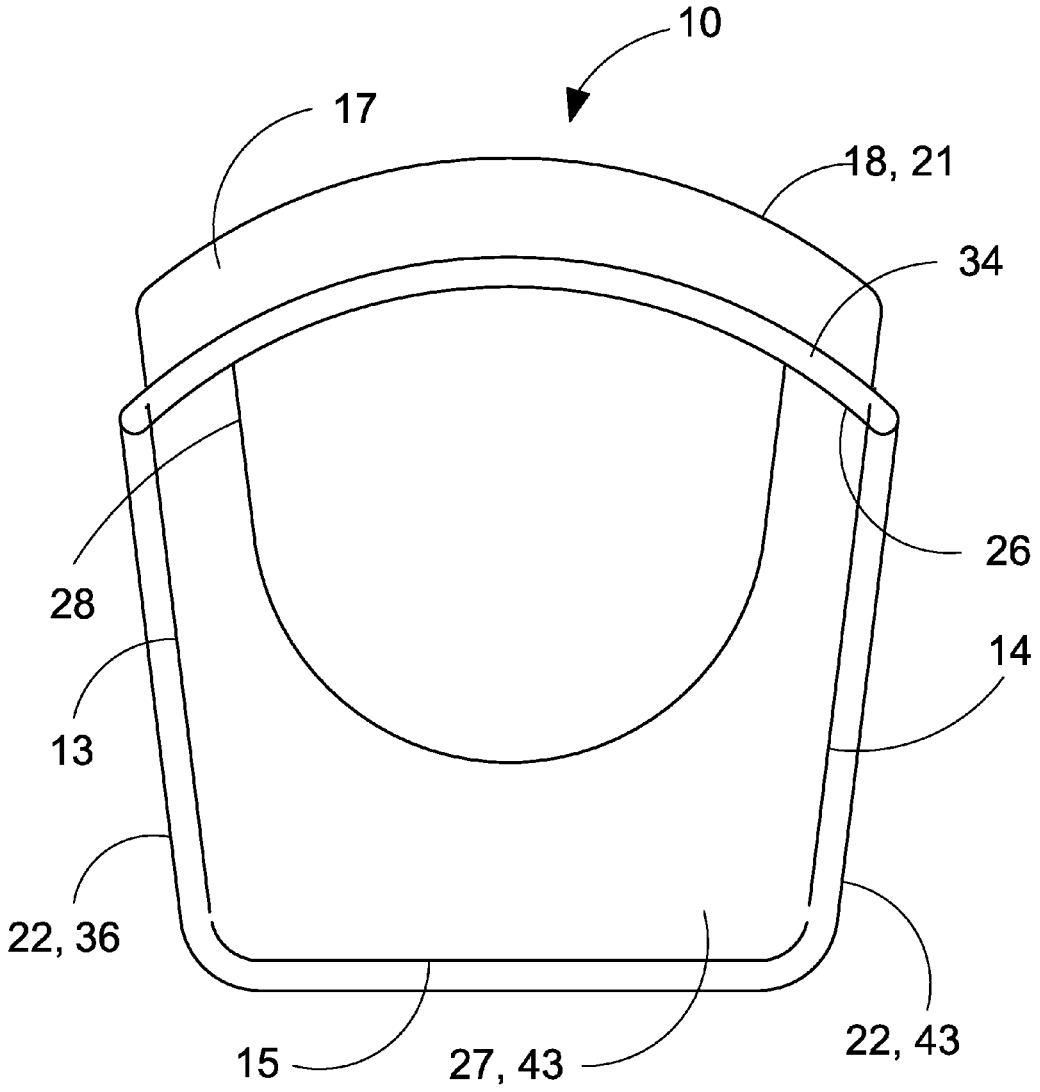
FIG. 3 is a plan view of the exercise unit 10, looking downward, the secondary foam layer 28, the top of the upper foam segment 43, the lip 34, and the inner surface 17 of the support base 18 being visible.

In FIG. 3, there is shown a top view of the exercise unit 10, including the top surface of the main foam layer 27 and the top surface of the secondary foam layer 28. The upper platform 22 features a rounded lip 34, which is integral to the upper rim 30 (hidden from view) which extends continuously, with and corresponding to, the length of the upper rim 30. The lip 34 and the rim bottom perimeter 32 serve to provide a surface which the finger joints 46 (more readily seen in FIG. 2 and in FIG. 4) of a user may grasp while extending the fingertips into an opening 16 directly below the rim bottom perimeter 32. The support base 18 provides stability and flush contact with the floor or other surface upon which the user may be exercising. The base outer surface 19 (not shown) may be covered with any type of non-slip material 20 (not shown) to prevent slipping or sliding of the support base 18 of the exercise unit 10 along the floor.

In the preferred embodiment, a fabric cover 42 (shown in FIG. 4) may be securely and snugly fitted over both the main foam layer 27 and the secondary foam layer 28 to provide another degree of comfort for the user. The exercise unit 10 provides a user with an extremely comfortable apparatus and support mechanism on which to put the heel 47 of his/her hand and wrist 49 when supporting the body weight during certain types of floor exercise. These features are more readily seen in FIG. 4.

Again, FIG. 3 demonstrates that the rearward portion of the secondary foam layer 28 is tapered from side-to-side and rounded at the rearward portion. This feature enhances comfort of the heel 47 (not shown) of the user's hand when the exercise unit 10 is in use. The upper rim 30 (out of view) and lip 34 of the upper platform help keep the lower foam section 44 from sliding off the top of the upper platform 22, in addition to an adhesive 6, which is also used to attach the upper and lower foam sections 43, 44 (adhesive is partially shown in FIG. 2).

The portion of a user's weight being brought to bear on the exercise unit 10 is placed directly onto the main foam layer 27, (comprising the upper foam segment 43 and the lower foam segment 44), as transmitted through the palm of a user, with the user's fingers comfortably curled into the opening 16 of the exercise unit 10.

In referring again to FIG. 2, it is emphasized that the rounded shape of the upper rim 30 and lip 34, just above the opening 16 make it very comfortable for the hand to rest on the upper foam segment 43 and have the fingers wrap underneath the rim bottom perimeter 32. This gripping position would be much more difficult to accomplish if there was a straight edge in the vicinity of the upper rim 30. This comfortable position substantially relieves a very common wrist pain reportedly experienced during the weight bearing portion of workouts utilizing the exercise unit 10. It should be noted that, in the preferred embodiment, different densities of latex foam provide the most effective combination of support and softness.

As is evident in FIG. 3, the upper platform 22 and the main foam layer 27 are constructed with a taper 36 (or angling) from front to rear of the exercise unit 10. The support base 18, the base rounded front 21, and the base inner surface 17 are partially in view. The taper 36 of the device to a narrower dimension toward the rear wall 15 allows the user to shift his/her hand position during use of the exercise unit 10. In particular, the taper 36 allows moving the user's hand more toward the thumb side by actually dropping the lower thumb joint 37 slightly off the top of the main foam layer 27, which serves to relieve weight and pressure off the lower thumb joint. This is more clearly illustrated in FIG. 4. Actual experience has found this to be a very comfortable position for users who suffer from intermittent or consistent thumb pain. It is also intended that the curvature and rounded top of the lip 34 and the outside edge of the rim 30 allow for comfortable and smooth depression and rebound of the main foam layer 27 and any fabric cover 42 which may be attached.

Figure 4:
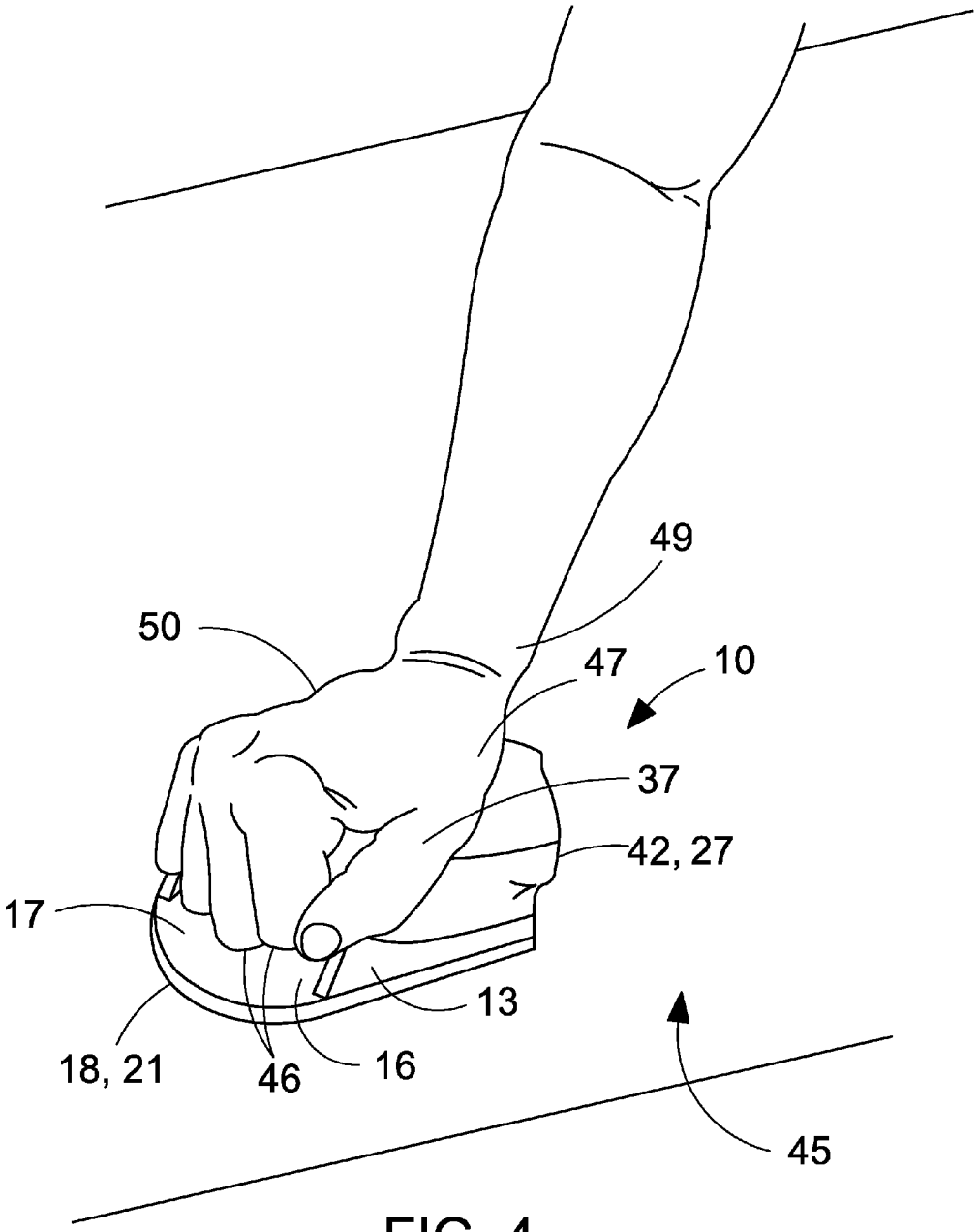
FIG. 4 illustrates a user having positioned his/her right hand and fingers 46 in the preferred gripping posture for the exercise unit 10.

FIG. 4 is a depiction of the exercise unit 10 being used with a custom-fitted fabric cover 42 having been placed over the secondary and main foam layers, 28, 27. The fabric cover 42 further comprises a rounded contour to correspond with the main foam rounded front 26 and rounded rear edges of the main foam layer 27.

FIG. 4 illustrates full use of the exercise unit 10, in which a user positions his right backhand 50 and fingers to effectuate the preferred method of gripping of the exercise unit 10. The exercise unit 10 is placed squarely on the floor surface 45 and resting on its support base 18. The user has placed the heel 47 of his hand, the palm 51 (not visible), and the thumb base 37 onto the fabric cover 42, which fits snugly over the main foam layer 27 of the exercise unit 10. The first finger joints 46 direct the upper portions of those four fingers into the opening 16 (only partially visible) of the exercise unit 10. The main foam layer 27 and the secondary foam layer 28, (covered by the fabric cover 42) serve to provide a cushioning effect to the user's wrist 49.

The fabric cover 42 is designed to "float" over the main foam layer 27 (hidden from view) as the main foam layer 27 is compressed and relieved repeatedly. Preferably the fabric cover 42 is attached to the exercise unit 10 by being expandable and capable of being fitted securely around the rear section of the rear wall 15, the rim bottom perimeter 32, and additionally, being retained by the lip 34.

In actual construction of the exercise unit 10, the preferred embodiment provides the most effective and functional dimensions in the ranges of 4.0 to 5.0 inches in width and 4.0 to 5.25 inches in length (from the base round front 21 to the rear wall 15). The height of the lip 34 above the upper platform 22 is preferred to be in the range from 0.125 inch to 0.5 inch. In the preferred embodiment, the height of the lip 34 above the upper platform 22 is 0.2 inch. The upper platform 22 is constructed with overlaps beyond the outer edge of the left wall 13, right wall 14, and rear wall 15 at a preferred dimension of 3/16 inch. The main foam layer 27 is constructed with a vertical thickness between 1.0 inch and 2.0 inches, with the preferred thickness being 1.5 inches. The secondary foam layer 28 is constructed with a thickness in the range of 0.125 inch to 0.625 inch, with the preferred thickness being 0.375 inch.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. An exercise unit constructed from a rigid material for supporting the heel, palm, and the inwardly-curled fingers of one hand of a user during exercise, the exercise unit comprising a frame, an upper platform, a main foam layer, and a secondary foam layer, further comprising:

said frame unit comprising a generally planar support base having a flat inner surface, a flat outer surface, a left side, a right side, a back end, an arcuate front end, a left wall, a right wall and a rear wall, wherein said left wall and said right wall are angled toward each other from front to back, with both walls being perpendicular to the inner surface of said support base, and further, said left wall and said right wall both slope downwardly from front to rear at an angle of slant between 4.0 degrees to 14.0 degrees;

said upper platform generally comprising a planar shape having an inner surface, an outer surface, and an arcuate upper rim, whereby said upper rim further comprises a continuous, rounded, upwardly-projecting lip integral to, and corresponding to the contour of said upper rim, and a correspondingly arcuate, bottom perimeter, wherein the font-to-back dimension of the inner surface of the upper platform being approximately twenty percent (20.0%) shorter than the outer surface of said support base;

said main foam layer comprising a three-dimensional shape forming a hexahedron wherein said main foam layer further comprises an upper foam segment and a lower foam segment in which the upper and lower surfaces of both foam segments have the same contour as the outer surface of the upper platform;

said secondary foam layer comprising a three-dimensional shape forming a hexahedron having a top surface, an undersurface, a front arcuate surface, a left side, a right side, and a rear surface, further exhibiting a narrowing taper from front to the rear of the secondary foam layer; wherein said upper platform is affixed, at its inner surface, atop the left wall, rear wall, and right wall of said support base, thereby forming a frontal opening defined by the upper rim of the upper platform, the left wall, right wall, and the inner surface of said support base, and further, the upper foam segment and the lower foam segment being adhesively attached to each other, in a vertically stacking manner, such that the resulting main foam layer exhibits a single, unified contour, and further, the lower surface of said lower foam segment being adhesively attached to the outer surface of said upper platform.

2. An exercise unit as in claim 1 wherein the perimeter of said upper platform overlaps the left wall, rear wall, and right wall of the support base by 3/16 inch.

3. An exercise unit as in claim 1 wherein a form-fitted, elastomeric cover encompasses the main foam layer and the upper platform.

4. An exercise unit as in claim 1 wherein a form-fitted elastomeric cover having a non-slip outer surface encompasses the main foam layer and the upper platform.

5. An exercise unit as in claim 1, wherein the upper foam segment and lower foam segment comprise two different densities of foam.

6. An exercise unit as in claim 1 wherein a material having non-slip properties is adhesively attached to the outer surface of the support base.

7. An exercise unit as in claim 1 wherein the upper foam segment comprises latex foam of a first density, and the lower foam segment comprises latex foam of a second density, differing from that of the upper foam segment.

8. An exercise unit constructed from a rigid material for supporting the heel, palm, and inwardly-curled fingers of one hand of a user during exercise, the exercise unit comprising a frame, an upper platform, a main foam layer, and a secondary foam layer, further comprising:

said frame comprising a generally planar support base having a flat inner surface with a length of 4.75 inches, a flat outer surface having a width of 4.5 inches, a left side, a right side, a back end, an arcuate front end, a left wall and a right wall, both walls being approximately 1.0 inches in height and a rear wall, wherein said left wall and said right wall are angled toward each other from front to back, with both walls being perpendicular to the inner surface of said support base, and further, said left wall and right wall both slope downwardly from front to rear at an angle of slant of six (6.0) degrees;

said upper platform generally comprising a planar shape having an inner surface, an outer surface, and an arcuate upper rim, whereby said upper rim further comprises a continuous, arcuate, upwardly-projecting lip 0.2 inch above said outer surface, and integral to, and corresponding to said upper rim, and a correspondingly arcuate bottom perimeter, the front-to-back dimension of the inner surface of said upper platform being approximately twenty percent (20.0%) shorter than the corresponding dimension of the outer surface of said support base, further the perimeter of the upper platform overlaps the left wall, rear wall, and right wall of the support base by 3/16 inch;

said main foam layer comprising a three-dimensional shape, forming a hexahedron having a depth of 1.5 inch, wherein said main foam layer further comprises an upper foam segment and a lower foam segment in which the upper and lower surfaces of both foam segments have the same contour as the outer surface of the upper platform;

said secondary foam layer comprising a three-dimensional shape of a thickness of 0.375 inch, and forming a hexahedron, having a top surface, an undersurface, a front rounded surface, a left side, a right side, and a rear surface, further having a narrowing taper from front to the rear of the secondary foam layer; wherein said upper platform is affixed, at its inner surface, atop the left wall, rear wall, and right wall of said support base, thereby forming a frontal opening defined by the upper rim of the upper platform, the left wall, right wall, and the inner surface of said support base, and further, the upper foam segment and the lower foam segment being adhesively attached to each other, in a vertically stacking manner, such that the resulting main foam layer exhibits a single, unified contour, and further, the lower surface of said lower foam segment being adhesively attached to the outer surface of said upper platform.

9. An exercise unit as in claim 8 wherein a form-fitted, elastomeric fabric cover encompasses the main foam layer and the upper platform.

10. An exercise unit as in claim 8 wherein a form-fitted elastomeric cover having a non-slip outer surface encompasses the main foam layer and the upper platform.

11. An exercise unit as in claim 8, wherein the upper foam segment and lower foam segment comprise two different densities of foam.

12. An exercise unit as in claim 8 wherein a material having non-slip properties is adhesively attached to the outer surface of the support base.

13. An exercise unit as in claim 8 wherein the upper foam segment comprises latex foam of a first density, and the lower foam segment comprises latex foam of a second density, differing from that of the upper foam segment.

14. An exercise unit constructed from a rigid material for supporting the heel, palm, and inwardly-curled fingers of one hand of a user, comprising a frame unit, an upper platform, a main foam layer, and a secondary foam layer, further comprising:

said frame unit comprising a generally planar support base having an inner surface with a front-to-back length in the range of 4.0 to 5.25 inches, a flat outer surface having a width in the range of 4.0 to 5.0 inches, a left side, a right side, a back end, an arcuate front end, a left wall, and a right wall, both approximately 1.0 inches in height, and a rear wall; wherein said left wall and said right wall are angled toward each other from front to back, with both walls being perpendicular to the inner surface of said support base, and further, said left wall and right wall both slope downwardly from front to rear at an angle of slant between 4.0 to 14.0 degrees;

said upper platform generally comprising a planar shape having an inner surface, an outer surface, and an arcuate upper rim, whereby said upper rim further comprises a continuous, arcuate, upwardly-projecting lip having a height in the range of 0.125 to 0.20 inch above said outer surface, and integral to, and corresponding to said upper rim, and a correspondingly arcuate bottom perimeter, the front-to-back dimension of the inner surface of said upper platform being approximately twenty percent (20.0%) shorter than the corresponding dimension of the outer surface of said support base;

said main foam layer comprising a three-dimensional shape, forming a hexahedron having a depth in the range of 1.5 inch to 2.0 inches, wherein said main foam layer further comprises an upper foam segment and a lower foam segment, the upper and lower surfaces of both foam segments have the same contour as the outer surface of the upper platform;

said secondary foam layer comprising a three-dimensional shape of a thickness in the range of 0.125 inch to 0.625 inch, and forming a hexahedron, having a top surface, an undersurface, a front rounded surface, a left side, a right side, and a rear surface, further having a narrowing taper from front to the rear of the secondary foam layer; wherein said upper platform is joined, at its inner surface, atop the left wall, rear wall, and right wall of said planar support base, thereby forming a frontal opening defined by the upper rim of the upper platform, the left wall, right wall, and the inner surface of said support base, and further, the upper foam segment and the lower foam segment being adhesively attached to each other, in a vertically stacking manner, such that the resulting main foam layer exhibits a single, unified contour, and further, the lower surface of said lower foam segment being adhesively attached to the outer surface of said upper platform.

15. An exercise unit as in claim 14 wherein the perimeter of said upper platform overlaps the left wall, rear wall, and right wall of the support base by 3/16 inch.

16. An exercise unit as in claim 14 wherein a form-fitted, elastomeric fabric cover encompasses the main foam layer and the upper platform.

17. An exercise unit as in claim 14 wherein a form-fitted elastomeric cover having a non-slip outer surface encompasses the main foam layer and the upper platform.

18. An exercise unit as in claim 14, wherein the upper foam segment and lower foam segment comprise two different densities of foam.

19. An exercise unit as in claim 14 wherein a material having non-slip properties is adhesively attached to the outer surface of the support base.

20. An exercise unit as in claim 14 wherein the upper foam segment comprises latex foam of a first density, and the lower foam segment comprises latex foam of a second density, differing from that of the upper foam segment.

* * * * *